US009278526B1

(12) United States Patent
Slenes et al.

(10) Patent No.: US 9,278,526 B1
(45) Date of Patent: Mar. 8, 2016

(54) MODULAR PRINTHEAD SUB-ASSEMBLY

(71) Applicant: XEROX CORPORATION, Norwalk, CT (US)

(72) Inventors: Chad Johan Slenes, Sherwood, OR (US); Samuel Vincent Schultz, Portland, OR (US); William Bruce Weaver, Canby, OR (US); Jon Garret Judge, Tigard, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/513,793

(22) Filed: Oct. 14, 2014

(51) Int. Cl.
*B41J 2/045* (2006.01)
*B41J 2/14* (2006.01)
*B41J 2/16* (2006.01)

(52) U.S. Cl.
CPC ..... *B41J 2/14274* (2013.01); *B41J 2/14201* (2013.01); *B41J 2/1612* (2013.01)

(58) Field of Classification Search
CPC ..... B41J 2/14201
See application file for complete search history.

(56) References Cited

U.S. PATENT DOCUMENTS

| | | | | |
|---|---|---|---|---|
| 6,428,142 | B1 | 8/2002 | Silverbrook et al. | |
| 7,404,623 | B2 | 7/2008 | Silverbrook et al. | |
| 2003/0098901 | A1 * | 5/2003 | Okuda | 347/68 |
| 2012/0187076 | A1 * | 7/2012 | Dolan et al. | 216/13 |

FOREIGN PATENT DOCUMENTS

WO 0142021 A1 6/2001

* cited by examiner

*Primary Examiner* — Geoffrey Mruk
(74) *Attorney, Agent, or Firm* — MH2 Technology Law Group LLP

(57) ABSTRACT

A printhead for a printer and methods for making the printhead. The printhead may include a driver module on a jetstack. The jetstack may include a plurality of holes formed therethrough. A first adhesive layer may be disposed on the jetstack. A diaphragm plate may be disposed on the first adhesive layer. A piezoelectric layer may be disposed on the diaphragm plate. A second adhesive layer may be disposed on the piezoelectric layer. A chip on flex may be disposed on the second adhesive layer.

11 Claims, 9 Drawing Sheets

MODULAR PRINTHEAD SUB-ASSEMBLY

TECHNICAL FIELD

The present teachings relate to a printer and, more particularly, to a printhead for a printer.

BACKGROUND

A printer creates an image or structure by propelling droplets of "ink" onto a medium such as paper, plastic, or other substrates. The printer has a printhead disposed at least partially therein. A conventional printhead is designed as a single, monolithic component that includes a jetstack, a piezoelectric device, and drive electronics (e.g., a circuit board, electrical cables, etc.).

When a printhead fails (e.g., to pass inspection), oftentimes, the entire printhead is discarded. This is the case even though only one component in the printhead (e.g., the electronics) may be faulty while the other components are operational. What is needed, therefore, is an improved system and method for reducing the amount and/or number of components that go to waste when a printhead fails to pass inspection.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A printhead for a printer is disclosed. The printhead may include a driver module. The driver module may include a jetstack including a plurality of holes formed therethrough. A first adhesive layer may be disposed on the jetstack. A diaphragm plate may be disposed on the first adhesive layer. A piezoelectric layer may be disposed on the diaphragm plate. A second adhesive layer may be disposed on the piezoelectric layer. A chip on flex may be disposed on the second adhesive layer.

In at least one embodiment, the printhead may include two or more driver modules positioned side by side. Each driver module may include a jetstack having a plurality of holes formed therethrough. A first adhesive layer may be disposed on the jetstack. A diaphragm plate may be disposed on the first adhesive layer, and the diaphragm plate may be made from steel and have a thickness from about 10 μm to about 50 μm. A piezoelectric layer may be disposed on the diaphragm plate. The piezoelectric layer may be or include lead zirconium titanate and have a thickness from about 20 μm to about 100 μm. The piezoelectric layer may include two or more parallel longitudinal arrays. A second adhesive layer may be disposed on the piezoelectric layer. The second adhesive layer may have a thickness from about 20 μm to about 80 μm, and the second adhesive layer may have a plurality of holes formed therethrough that are substantially aligned with the holes in the jetstack. A spacer layer may be at least partially disposed around the piezoelectric layer and between the diaphragm plate and the adhesive layer. The spacer layer may be or include polyimide and have a thickness from about 20 μm to about 100 μm. A portion of the spacer layer may be disposed between the two or more parallel longitudinal arrays of the piezoelectric layer. A chip on flex may be disposed on the adhesive layer. A first of the two or more driver modules may be configured to be removed from the printhead while a second of the two or more driver modules remains in the printhead.

A method for building a driver module for a printhead is also disclosed. The method may include adhering a first side of a first adhesive layer to a carrier plate. A second side of the first adhesive layer may be adhered to a diaphragm plate, and the diaphragm plate may be coupled to a piezoelectric layer. A spacer layer may be placed at least partially around the piezoelectric layer such that an upper surface of the spacer layer is substantially aligned with an upper surface of the piezoelectric layer. A second adhesive layer may be adhered to the upper surfaces of the spacer layer and the piezoelectric layer. A chip on flex may be adhered to the second adhesive layer. Removal of the first adhesive layer and carrier plate may be done to complete the build of the driver module.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the figures have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same, similar, or like parts.

As used herein, unless otherwise specified, the word "printer" encompasses any apparatus that performs a print outputting function for any purpose, such as a digital copier, bookmaking machine, facsimile machine, a multi-function machine, electrostatographic device, three dimensional printer, etc.

Figure 1:
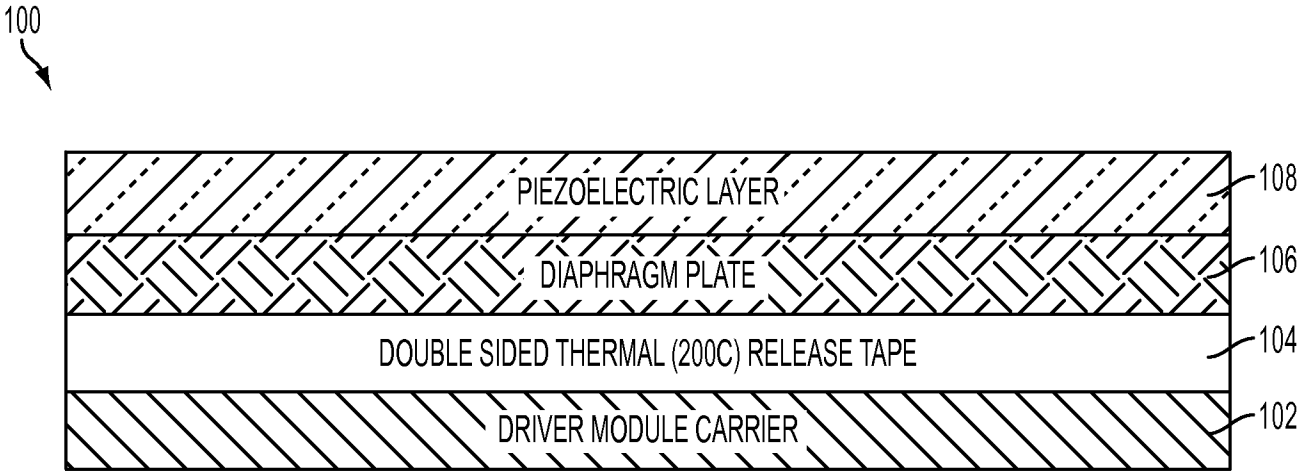
FIG. 1 depicts a schematic cross-sectional view of a driver module carrier plate, an adhesive layer, and a diaphragm plate, according to one or more embodiments disclosed.

It will be understood that the structures depicted in the figures may include additional features not depicted for simplicity, while depicted structures may be removed or modified. FIGS. 1-10 depict an illustrative sequence for building an illustrative driver module 100 for a printhead. More particularly, FIG. 1 depicts a schematic cross-sectional view of a driver module carrier plate 102, a first adhesive layer 104, and a diaphragm plate 106, according to one or more embodiments disclosed. The driver module carrier plate 102 may be made from metal such as steel (e.g., stainless steel). The driver module carrier plate 102 may have a thickness from about 50 μm to about 1000 μm, about 100 μm to about 500 μm, or about 200 μm to about 400 μm.

A first adhesive layer 104 may be disposed on and/or over the driver module carrier plate 102. The first adhesive layer 104 may be or include tape having an adhesive material on one or both sides. As shown, the first adhesive layer 104 is a double-sided tape having the adhesive material on both sides, and the driver module carrier plate 102 is adhered to a first or "lower" side of the first adhesive layer 104. The second or "upper" side of the first adhesive layer 104 may be configured to release one or more of the layer(s) stuck thereto when exposed to a predetermined temperature. The temperature may be greater than or equal to about 170° C., about 200° C., about 230° C., or more.

A diaphragm plate 106 may be disposed on and/or over the first adhesive layer 104. As shown, the diaphragm plate 106 is adhered to a second or "upper" side of the first adhesive layer 104. The diaphragm plate 106 may be made from metal such as steel (e.g., stainless steel). The diaphragm plate 106 may have a thickness from about 5 μm to about 100 μm, about 10 μm to about 50 μm, or about 15 μm to about 30 μm.

A piezoelectric layer 108 may be disposed on and/or over the diaphragm plate 106. The piezoelectric layer 108 may be or include lead zirconium titanate, also referred to as "PZT." The piezoelectric layer 108 may have a thickness from about 10 μm to about 150 μm, about 20 μm to about 100 μm, or about 40 μm to about 60 μm.

Figure 2:
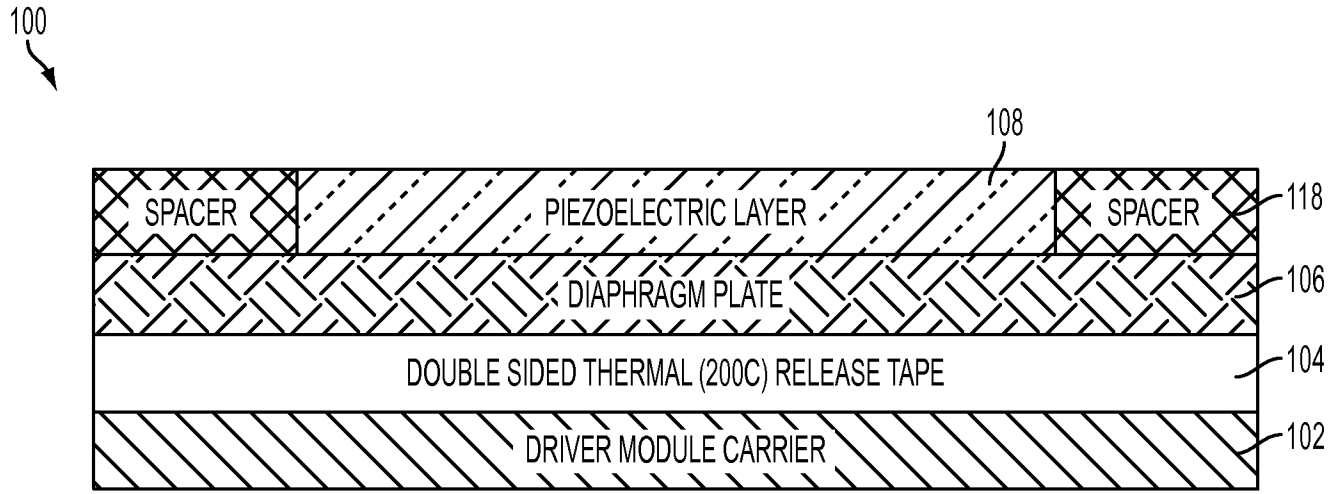
FIG. 2 depicts a schematic cross-sectional view of a spacer layer being added to the driver module, according to one or more embodiments disclosed.

FIG. 2 depicts a schematic cross-sectional view of a spacer layer 118 being added to the driver module 100, according to one or more embodiments disclosed. The spacer layer 118 may be placed on and/or over the diaphragm plate 106. The spacer layer 118 may also be placed at least partially around or adjacent to the piezoelectric layer 108. The spacer layer 118 may be made from one or more polymers such as imide monomers. For example, the spacer layer 118 may be made from polyimide. The spacer layer 118 may also include an adhesive material. The spacer layer 118 may have a thickness that is substantially the same as the piezoelectric layer 108 so that the upper surface of the spacer layer 118 is substantially flat and aligned with the upper surface of the piezoelectric layer 108. For example, the spacer layer 118 may have a thickness from about 10 μm to about 150 μm, about 20 μm to about 100 μm, or about 40 μm to about 60 μm.

Figure 3:
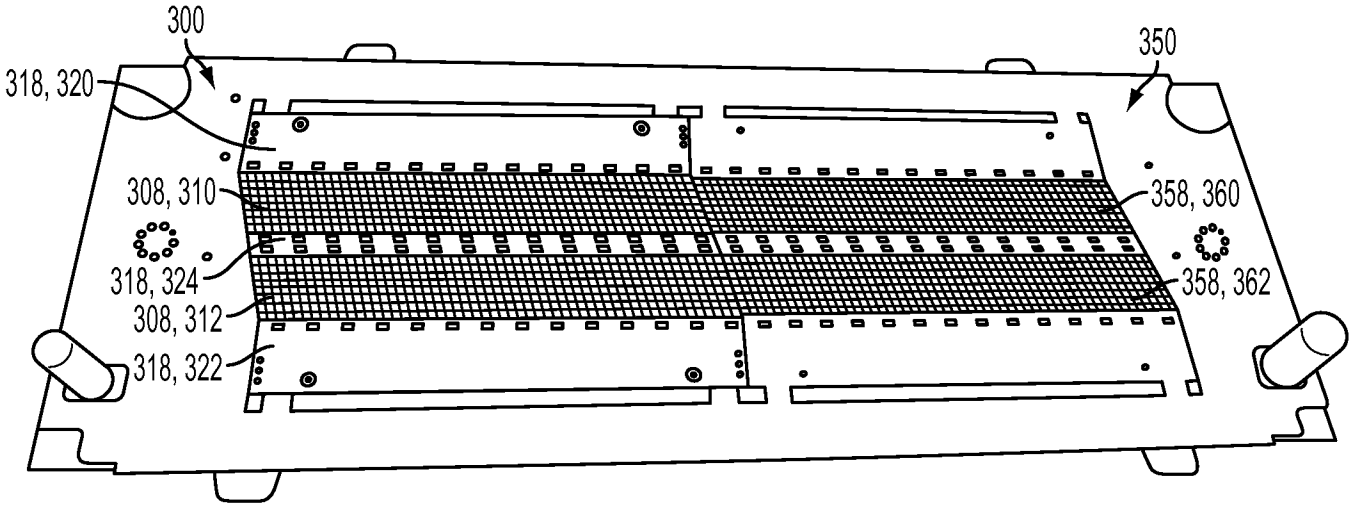
FIG. 3 depicts a perspective view of two driver modules side by side with one of the driver modules including the spacer layer, according to one or more embodiments disclosed.

FIG. 3 depicts a perspective view of two driver modules 300, 350 side by side with one of the driver modules 300 including a spacer layer 318, according to one or more embodiments disclosed. The driver modules 300, 350 may be similar to the driver module 100 shown in FIGS. 1 and 2. As shown, the first or "left" driver module 300 has the spacer layer 318 disposed thereon, while the spacer layer has not yet been applied to the second or "right" driver module 350.

Each driver module 300, 350 may have a piezoelectric layer 308, 358 and a spacer layer 318. As shown, a first spacer layer 318 has been placed on the first driver module 300, but the second spacer layer has not yet been placed on the second driver module 350. Each spacer layer 318 may include one or more portions (three are shown 320, 322, 324). First and second portions 320, 322 of the spacer layer 318 may be placed outside the longitudinal arrays 310, 312, respectively, and a third portion 324 of the spacer layer 318 may be placed in between the longitudinal arrays 310, 312. As mentioned above, when in place, the upper surfaces of the portions 320, 322, 324 of the spacer layer 318 are substantially flat and aligned with the upper surfaces of the longitudinal arrays 310, 312 of the piezoelectric layer 308.

Figure 4:
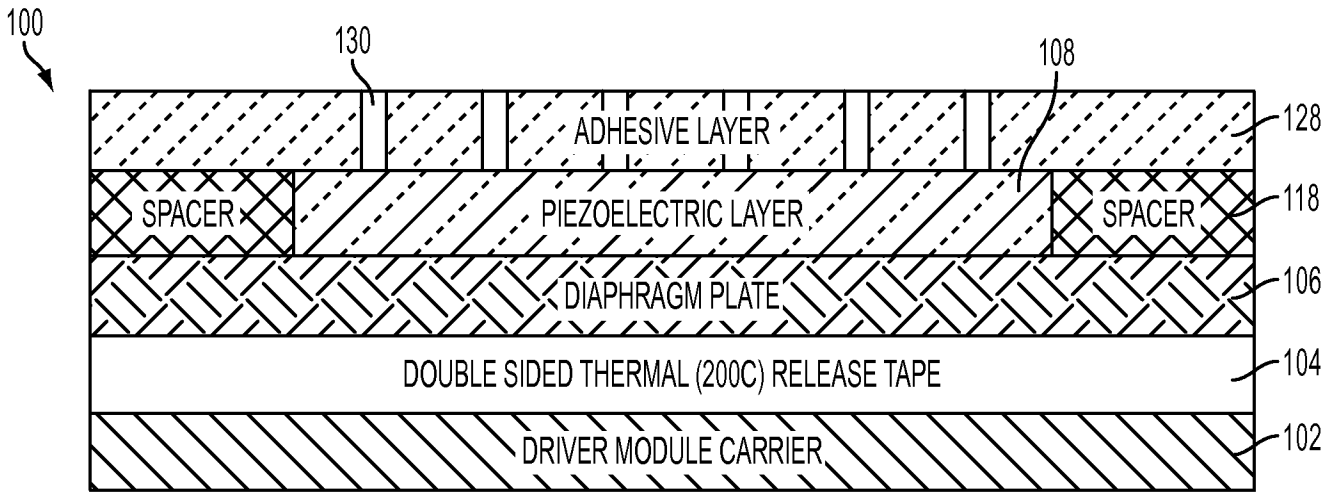
FIG. 4 depicts a schematic cross-sectional view of an adhesive layer being added to the driver module, according to one or more embodiments disclosed.

FIG. 4 depicts a schematic cross-sectional view of a second adhesive layer 128 being added to the driver module 100, according to one or more embodiments disclosed. The second adhesive layer 128 may be placed on and/or over the piezoelectric layer 108 and/or the spacer layer 118. The second adhesive layer 128 may be made from an adhesive material. The second adhesive layer 128 may have a thickness from about 5 μm to about 100 μm, about 20 μm to about 80 μm, or about 40 μm to about 60 μm. The second adhesive layer 128 may have a plurality of holes 130 formed therethrough. The number of holes 130 in the second adhesive layer 128 may range from about 1 to about 512.

Figure 5:
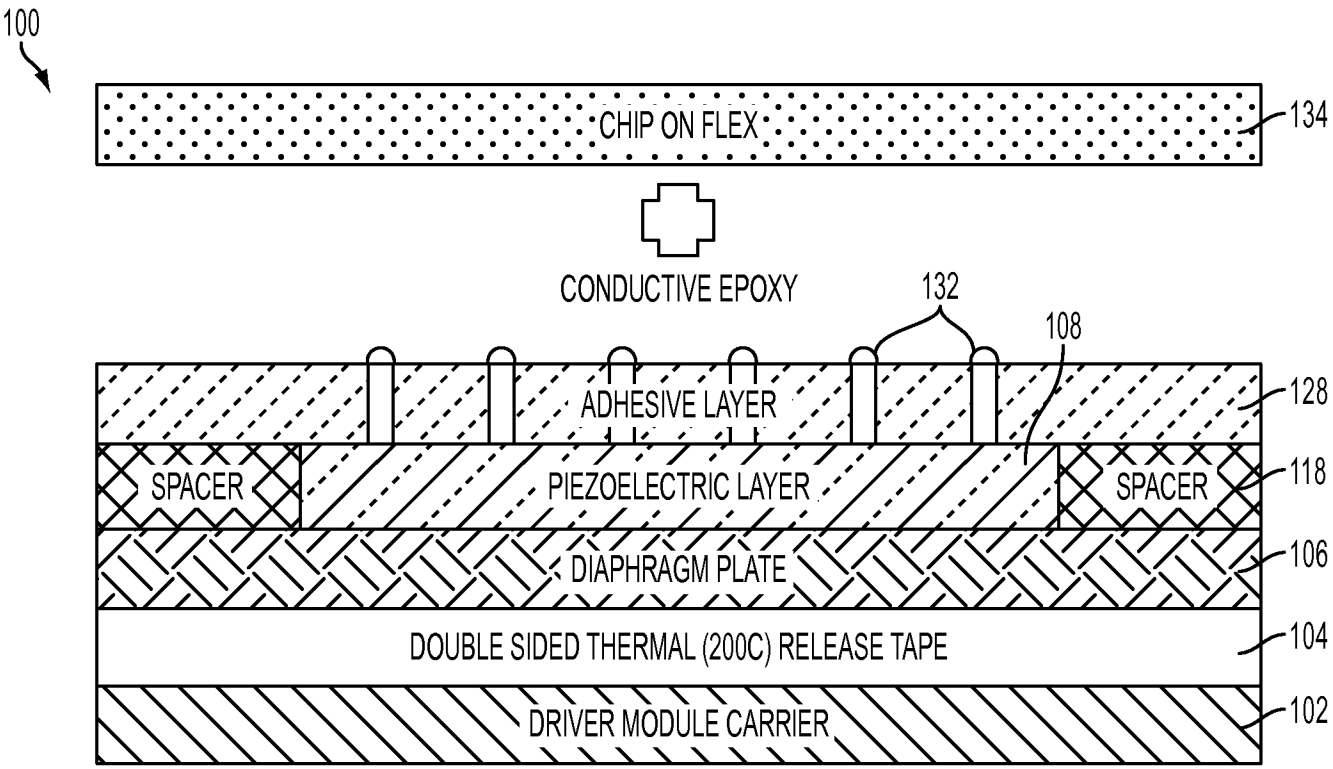
FIG. 5 depicts a schematic cross-sectional view of a conductive epoxy and a chip on flex being added to the driver module, according to one or more embodiments disclosed.

FIG. 5 depicts a schematic cross-sectional view of a conductive epoxy 132 and a chip on flex 134 being added to the driver module 100, according to one or more embodiments disclosed. A conductive epoxy 132 may be placed on and/or over the second adhesive layer 128. At least a portion of the conductive epoxy 132 may become disposed within the holes 130 in the second adhesive layer 128. The conductive epoxy 132 may be made from silver, copper, gold, or a combination thereof.

As shown by the plus sign ("+") in FIG. 5, one or more chips on flexes 134 may then be placed on the conductive epoxy 132 and/or the second adhesive layer 128. The chip on flex 134 may be or include a semiconductor assembly coupled to and electrically connected to a flexible circuit (i.e., a circuit built on a flexible substrate). The chip on flex 134 may have a thickness from about 25 μm to about 200 μm, about 50 μm to about 150 μm, or about 65 μm to about 100 μm.

Figure 6:
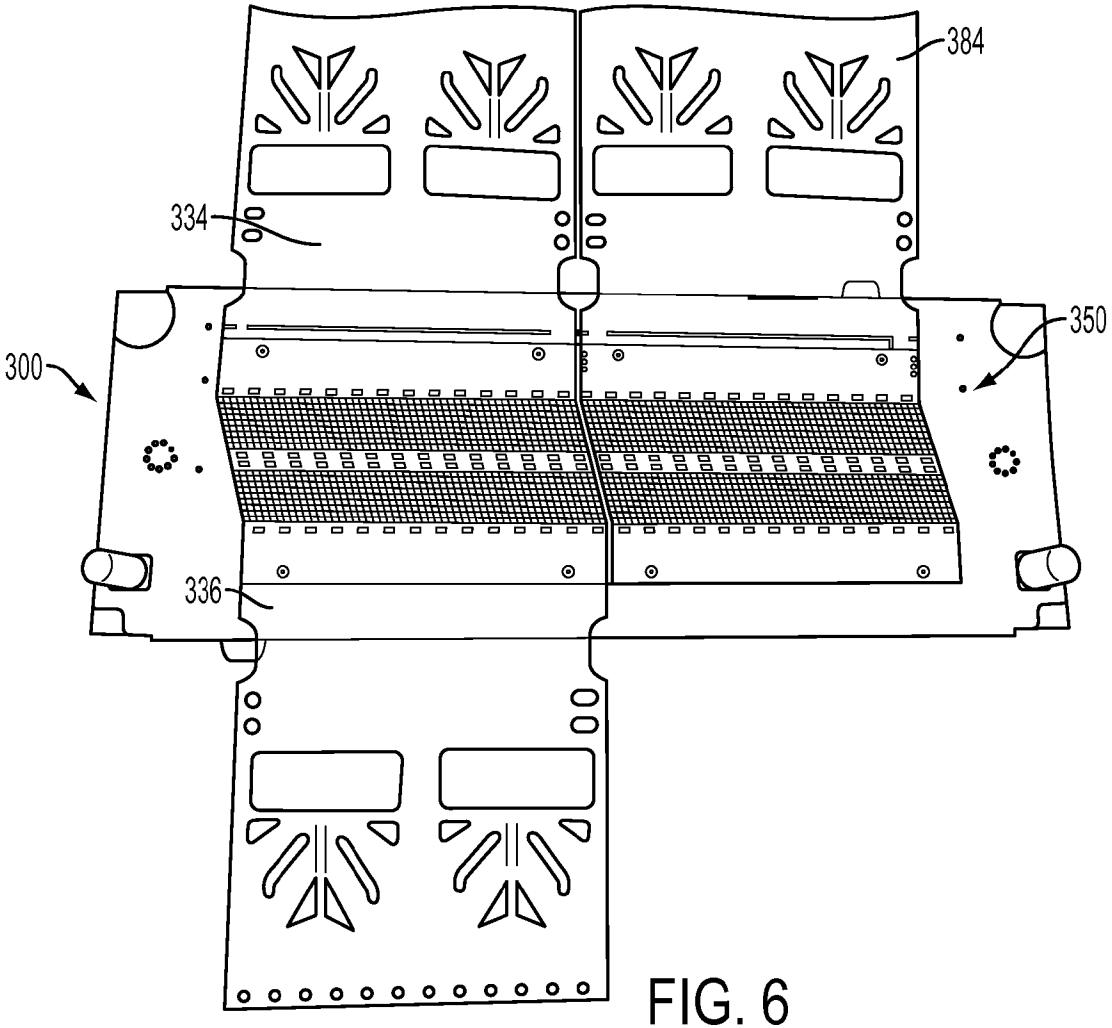
FIG. 6 depicts a perspective view of two driver modules shown in FIG. 3 with three of four chips on flexes being placed thereon, according to one or more embodiments disclosed.

FIG. 6 depicts a perspective view of the two driver modules 300, 350 shown in FIG. 3 with the chips on flexes 334, 336, 384 being placed thereon, according to one or more embodiments disclosed. As shown, the first driver module 300 has two chips on flexes 334, 336 disposed thereon. The second driver module 350 is shown having one chip on flex 384 disposed thereon, and the second chip on flex has not yet been added.

The first chip on flex 334 may be disposed at least partially over the first longitudinal array 310 of the piezoelectric layer 308 of the first driver module 300. The second chip on flex 336 may be disposed at least partially over the second longitudinal array 312 of the piezoelectric layer 308 of the first driver module 300. The third chip on flex 384 may be disposed at least partially over the first longitudinal array 360 of the piezoelectric layer 358 of the second driver module 350. Although not shown, the fourth chip on flex will be disposed at least partially over the second longitudinal array 362 of the piezoelectric layer 358 of the second driver module 350. This arrangement may allow the wires in the chips on flexes 334, 336, 384 to be aligned with and in electrical communication with (through the holes 130 in the second adhesive layer 128) the arrays 310, 312, 360, 362 of the piezoelectric layers 308, 358.

Figure 7:
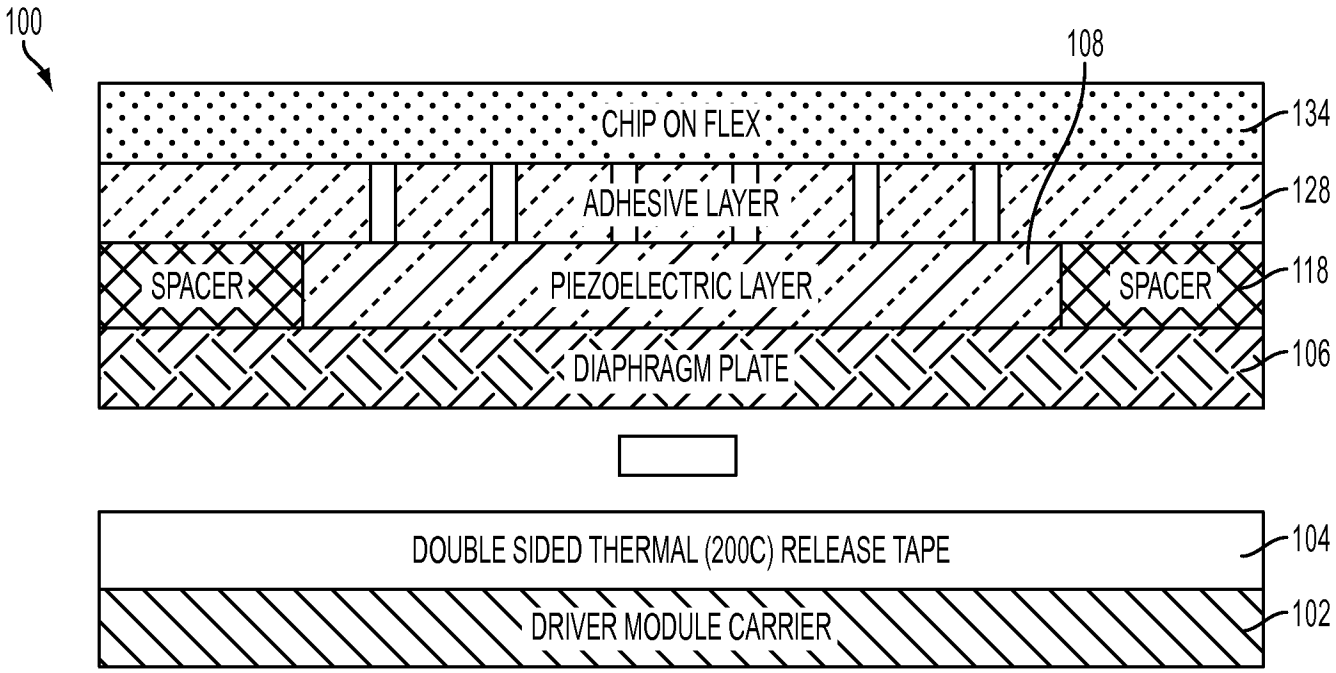
FIG. 7 depicts a schematic cross-sectional view of an adhesive layer and the driver module carrier plate being removed from the driver module, according to one or more embodiments disclosed.

FIG. 7 depicts a schematic cross-sectional view of the driver module carrier plate 102 and the first adhesive layer 104 being removed from the driver module 100, according to one or more embodiments disclosed. Once the chip on flex 134 is coupled to the driver module 100, the driver module 100 may be heated to a temperature from about 140° C. to about 200° C., about 140° C. to about 170° C., or about 170° C. to about 200° C. from about 5 minutes to about 120 minutes, about 10 minutes to about 60 minutes, or about 20 minutes to about 40 minutes. This may bond the chip on flex 134 to the adhesive layer 128. This may also cause the first adhesive layer 104 to release from the diaphragm plate 106. Thus, as shown by the minus sign ("−") in FIG. 7, the driver module carrier plate 102 and the first adhesive layer 104 may be removed from the driver module 100.

Once assembled, the driver module 100 (see also driver modules 300, 350 in FIGS. 3 and 7) may be tested to determine whether a successful electrical connection exists between the chip on flex 134 and the piezoelectric layer 108. If the driver module 100 fails the test, the driver module 100 may be discarded or used in a printhead with lower requirements (and/or price). Illustrative failures may include grounded electrical connections, open electrical connections, low electrical connections, high electrical connections, shorted-together electrical connection, and the like. If the driver module 100 passes the test, the driver module 100 may be inserted into a printhead.

Figure 8:
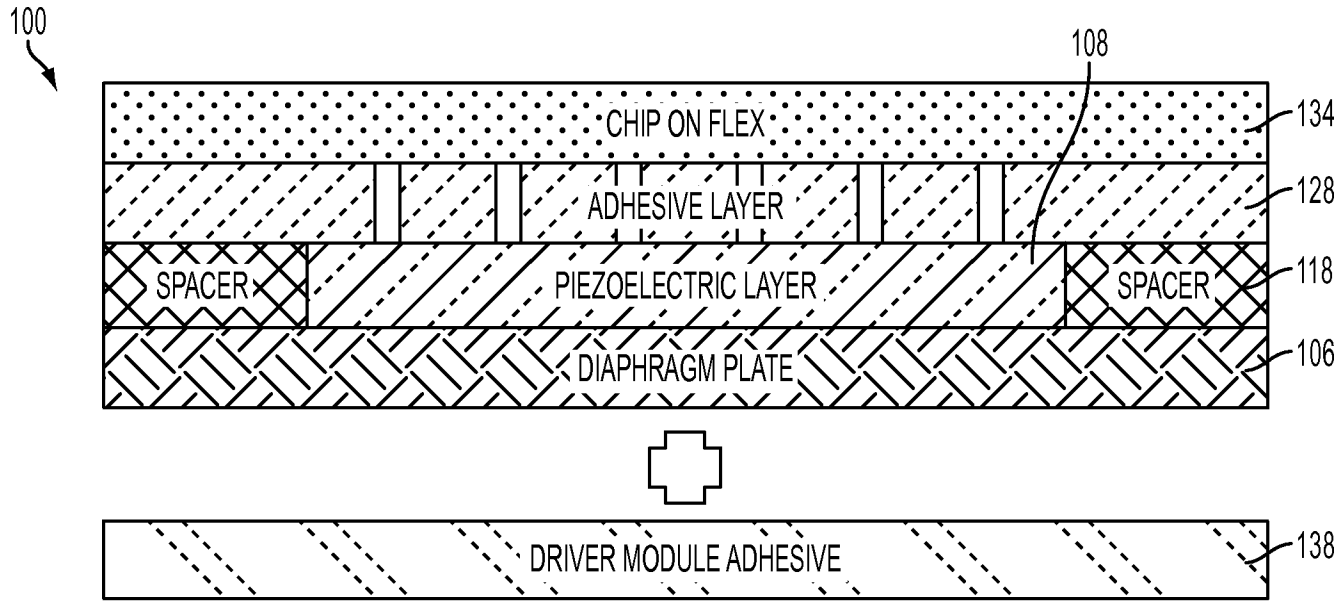
FIG. 8 depicts a schematic cross-sectional view of an adhesive layer being added to the driver module, according to one or more embodiments disclosed.

FIG. 8 depicts a schematic cross-sectional view of a third adhesive layer 138 being added to the driver module 100, according to one or more embodiments disclosed. As shown by the plus sign ("+") in FIG. 8, the third adhesive layer 138 may be applied to the diaphragm plate 106. The third adhesive layer 138 may be made from epoxy, thermoplastics, or combinations thereof.

Figure 9:
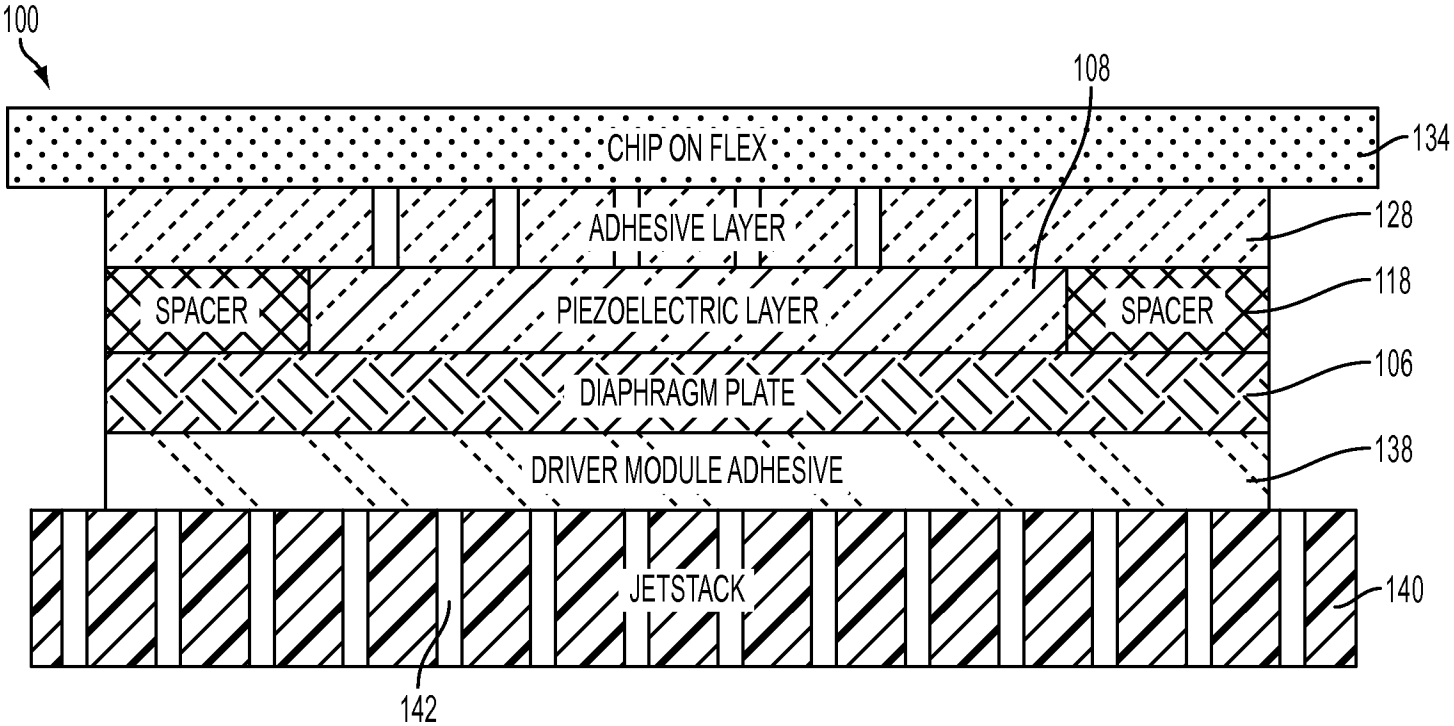
FIG. 9 depicts a schematic cross-sectional view of a driver module being applied to the jetstack, according to one or more embodiments disclosed.

FIG. 9 depicts a schematic cross-sectional view of a driver module 100 being added to a jetstack 140, according to one or more embodiments disclosed. The third adhesive layer 138 may be adhered to the jetstack 140. The jetstack 140 may include a plurality of holes or "jets" 142 formed therethrough. For example, the number of jets 142 in each jetstack 140 may be from about 100 to about 2,000, about 2,000 to 5,000, or about 5,000 to about 10,000. The jets 142 in the jetstack 140 may be substantially aligned with the holes 130 in the second adhesive layer 128. In at least one embodiment, a single jetstack 140 may be aligned with one or more driver modules (e.g., 300, 350 in FIG. 3).

The driver module 100 may be one of multiple driver modules inserted into a single printhead. The number of driver modules 100 inserted into a single printhead may be from about 2 to about 4, about 4 to about 8, or about 8 to about 16, or more. In at least one embodiment, two driver modules 100 including a total of 1760 jets 142 may be inserted into a single printhead. In another embodiment, six driver modules 100 including a total of 4944 jets 142 may be inserted into a single printhead. In yet another embodiment, eight driver modules 100 including a total of 7040 jets 142 may be inserted into a single printhead.

The multiple driver modules 100 may have the same number of jets (in the aggregate) as a larger, conventional, monolithic driver module. As such, the multiple driver modules 100 may function together in the printhead in much the same way as the larger, conventional, monolithic driver module. However, when a failure occurs in one of the multiple driver modules 100, either during the testing phase or after the printhead has been in use, the failure is isolated to that particular one of multiple driver modules 100. Thus, that particular one of the multiple driver modules 100 may be removed from the printhead and repaired or discarded while the remainder of the multiple driver modules 100 (and the components/layers therein) may remain in the printhead and/or ready for use. In at least one embodiment, the removed driver module 100 may be replaced with another driver module.

Once the driver modules 100 have been inserted into the printhead, in operation, electrical signals may sent thru the chip on flex 134, to the piezoelectric layer 108, where the electrical signal is changed from an electrical signal into a mechanical actuation, causing fluid and/or "ink" do be ejected thru one of the plurality of holes in the jetstack 140. This ejected droplet of ink, with a plurality of other such droplets, may create an image and/or layer of a three dimensional object.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" may include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter may take on negative values. In this case, the example value of range stated as "less than 10" may assume negative values, e.g. −1, −2, −3, −10, −20, −30, etc.

While the present teachings have been illustrated with respect to one or more implementations, alterations and/or modifications may be made to the illustrated examples without departing from the spirit and scope of the appended claims. For example, it may be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It may be appreciated that structural components and/or processing stages may be added, or existing structural components and/or processing stages may be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items may be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, the terms "exemplary" or "illustrative" indicate the description is used as an example, rather than implying that it is an ideal. Other embodiments of the present teachings may be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A printhead, comprising:

a driver module comprising:

a carrier plate;

a first adhesive layer disposed on the carrier plate;

a diaphragm plate disposed on the first adhesive layer;

a piezoelectric layer disposed on the diaphragm plate;

a second adhesive layer disposed on the piezoelectric layer, wherein the second adhesive layer has a plurality of holes formed therethrough along the length of the piezoelectric layer that are directly above the piezoelectric layer; and a chip on flex disposed on the second adhesive layer.

2. The printhead of claim 1, wherein the driver module is configured to be removed from the printhead while a second driver module remains in the printhead.

3. The printhead of claim 1, wherein the piezoelectric layer comprises lead zirconium titanate and has a thickness from about 20 μm to about 100 μm.

4. The printhead of claim 1, wherein the piezoelectric layer comprises one or more parallel longitudinal arrays.

5. The printhead of claim 4, further comprising a spacer layer disposed between the diaphragm plate and the first adhesive layer, wherein the spacer layer comprises a polyimide and has a thickness from about 20 μm to about 100 μm.

6. The printhead of claim 5, wherein a portion of the spacer layer is disposed between the two or more parallel longitudinal arrays of the piezoelectric layer.

7. The printhead of claim 1, wherein the second adhesive layer has a thickness from about 20 μm to about 80 μm, and wherein the holes in the second adhesive layer formed therethrough are substantially aligned with the holes in the jetstack.

8. The printhead of claim 1, further comprising a conductive epoxy disposed at least partially within the holes formed through the second adhesive layer.

9. A printhead, comprising:

two or more driver modules positioned side by side, each driver module comprising:

a carrier plate;

a first adhesive layer disposed on the carrier plate;

a diaphragm plate disposed on the first adhesive layer, wherein the diaphragm plate comprises steel and has a thickness from about 10 μm to about 50 μm, wherein the first adhesive layer comprises a double-sided release tape that is configured to release the carrier plate, the diaphragm plate, or both when exposed to a temperature that is greater than or equal to about 170° C.;

a piezoelectric layer disposed on the diaphragm plate, wherein the piezoelectric layer comprises lead zirconium titanate and has a thickness from about 20 μm to about 100 μm, and wherein the piezoelectric layer comprises two or more parallel longitudinal arrays;

a second adhesive layer disposed on the piezoelectric layer, wherein the second adhesive layer has a thickness from about 20 μm to about 80 μm, and wherein the second adhesive layer has a plurality of holes formed therethrough that are along the length of the piezoelectric layer and directly above the piezoelectric layer;

a conductive epoxy disposed at least partially within the holes formed through the second adhesive layer;

a spacer layer at least partially disposed around the piezoelectric layer and between the diaphragm plate and the second adhesive layer, wherein the spacer layer comprises a polyimide and has a thickness from about 20 μm to about 100 μm, and wherein a portion of the spacer layer is disposed between the two or more parallel longitudinal arrays of the piezoelectric layer; and a chip on flex disposed on the second adhesive layer.

10. The printhead of claim 9, wherein a first of the two or more driver modules is configured to be removed from the printhead while a second of the two or more driver modules remains in the printhead.

11. The printhead of claim 9, wherein a jetstack is not yet coupled to either of the driver modules.

* * * * *